United States Patent [19]

Gershanow et al.

[11] 3,990,114

[45] Nov. 9, 1976

[54] GARMENT AND METHOD OF MANUFACTURE

[75] Inventors: Irving Gershanow, Roslyn; Alexander Korval, Great Neck, both of N.Y.

[73] Assignee: Petrocelli Clothes, Inc., New York, N.Y.

[22] Filed: May 21, 1975

[21] Appl. No.: 579,547

[52] U.S. Cl. ..... 2/93; 2/108; 2/125

[51] Int. Cl.[2] ..... A41D 27/10

[58] Field of Search ..... 2/93, 97, 108, 125, 2/243 R, 243 B, 268, 105, 106, 115

[56] References Cited

UNITED STATES PATENTS

| | | | |
|---|---|---|---|
| 1,642,627 | 9/1927 | Paley | 2/93 |
| 1,929,051 | 10/1933 | Blicher | 2/93 |
| 2,731,641 | 1/1956 | Toscani et al. | 2/93 |
| 2,866,203 | 12/1958 | Costanza | 2/93 |

*Primary Examiner*—Werner H. Schroeder
*Attorney, Agent, or Firm*—Kenyon & Kenyon Reilly Carr & Chapin

[57] ABSTRACT

Disclosed herein is a garment such as a coat or jacket having a unique shoulder and arm construction and a method for manufacturing such a garment. The body of the coat is provided with armholes positioned and formed so as to expose an elongated perimeter at the shoulder area in the upward direction and a reduced perimeter at the lower area. A sleeve is attached along the contours of these armholes. At the point of attachment of the sleeve to the upper portion of the armhole, excess material provided in the sleeve is gathered-in and stitched to impart an upwardly-directed tension at this point. The coat preferably includes a shoulder pad which is bowed during attachment to provide upwardly-directed forces.

11 Claims, 7 Drawing Figures

16
a
b
18
20
16
10

26
24

22
16
12

14
10
12

22
16
12

GARMENT AND METHOD OF MANUFACTURE

BACKGROUND OF THE INVENTION

This invention relates to garments, and more particularly to a novel shoulder and sleeve arrangement for garments and a method for their manufacture.

In the manufacture of coats such as suit jackets, sport jackets, overcoats, golf jackets, and the like, the body portion of the coat is provided with an armhole, conventionally referred to as an armscye, adjacent the shoulder portion of the body to which a sleeve is attached by suitable stitching. It is also known, of course, to provide pads in the shoulder portion of the coat or jacket, typically disposed between a lining and the garment fabric, so as to achieve a more proper fit or shape at the shoulder area of the coat. See, for example, U.S. Pat. Nos. 2,554,151 to Newhouse, dated May 22, 1951; 2,866,203 to Costanza, dated Dec. 20, 1958; and 2,117,163 to Haspel, dated May 10, 1938.

A substantial problem universally encountered with coats or jackets is centered around the ease of arm movement, more properly the lack thereof, when wearing the garment. Exemplary of attempts to obviate this difficulty are the following: U.S. Pat. No. 3,049,719 to Carmen, dated Aug. 21, 1962 and U.S. Pat. No. 2,514,276 to Berman, dated July 4, 1950.

A related but more vexing problem concerns the overall comfort experienced when wearing a coat especially for extended periods of time. It is not uncommon for the wearer to experience a fatigue of sorts, even where light-weight fabrics are utilized, due to the weight of the coat being supported primarily at the shoulder areas. While apparent even in the absence of extensive arm movement, this problem becomes aggravated during such movement, especially in the lateral or upward direction, since these motions are made in a direction opposed to the natural downward weight force of the garment.

It is accordingly an object of this invention to provide a coat or jacket garment constructed so as to reduce the weighty feeling thereof during wear.

A further object of this invention is to provide a coat or jacket garment which permits substantially less restricted arm movements unoccasioned by fatigue.

It is another object of this invention to provide such a garment as above-described through the use of a unique armscye and sleeve construction.

Still another object of this invention is to provide a garment as above-described containing shoulder pad means.

A still further object of this invention is to provide a method of manufacturing a coat garment so as to permit substantially less restricted arm movements and to limit the weighty feeling of such garments.

These and other objects will become apparent from the description and drawings which follow.

SUMMARY OF THE INVENTION

In accordance with this invention there is provided a garment comprised of a body portion which contains armholes adjacent the shoulder areas thereof. These armholes or armscyes are typically elliptical in shape and are disposed and oriented in the body portion such that the upwardly-facing perimeter of the armscye is elongated. At the same time the downwardly-facing perimeter of the armscye is reduced. A sleeve is provided for sewing into the armscye in contoured relation thereto. The upper portion of this sleeve is provided with an excess of material, as more fully defined hereinafter, at the sleevehead such that at the point of attachment of the sleeve to the upper contour of the armscye, the excess material is gathered-in and stitched.

In a particularly preferred embodiment of this invention wherein a shoulder pad is to be employed, the pad is designed such that its attachment across the upper armscye perimeter results in a bowing of the pad. The lower concave surface of the bowed pad retains a spaced relation above the armscye perimeter or shoulder edge to thereby permit less restricted arm movements and allow "room" for the exertion of upward and outward pressures.

BRIEF DESCRIPTION OF THE FIGURES

FIG. 2(*a*) is a schematic figure of the unique armscycle orientation of the invention.

DETAILED DESCRIPTION OF THE INVENTION

Figures 1, 2, 2A, 3, 4, 5, 6:
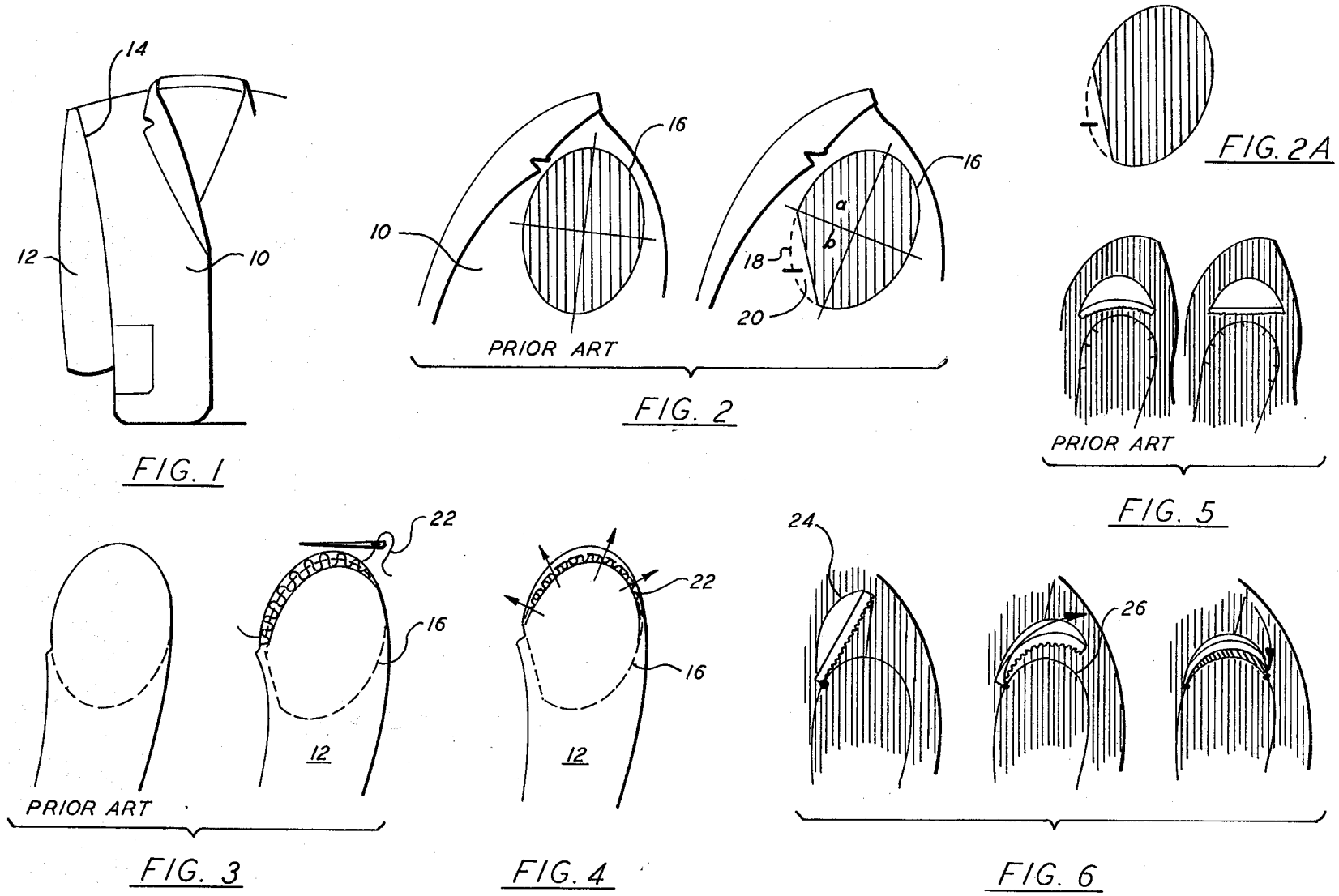
FIG. 2A PRIOR ART
PRIOR ART FIG. 2
PRIOR ART FIG. 3
FIG. 1 is a fragmentary front view of a jacket.
FIG. 2 is a fragmentary perspective view of the garment of this invention showing the novel armscye orientation as contrasted with that of the prior art.
FIG. 3 is a perspective view of the armscye and sleeve arrangement of this invention as contrasted with that of the prior art.
FIG. 4 is a perspective view of the armscye and sleeve arrangement of this invention.
FIG. 5 is a fragmentary perspective view of the shoulder and sleeve area of a garment showing a shoulder pad in accord with this invention as contrasted with that of the prior art.
FIG. 6 is a fragmentary perspective view of the shoulder and sleeve area of a garment showing the sequential steps for utilization of a shoulder pad in accordance with this invention.

In accordance with this invention there is provided a unique sleeve and armscye construction which results in a lessening of the typical downwardly-directed weight forces which restrict arm movement and eventually result in fatigue and loss of comfort. As will be seen this is to a large extent accomplished by both decreasing and counteracting these normal weight forces at the shoulder area. Garments constructed in accordance with this invention enable arm movements to be made more freely, affords a greater sense of comfort, imparts a feeling of buoyancy at the shoulders, reduces fatigue resulting from excessive arm movements and allows for longer periods of wear without customary removal for normal activities. The armholes seem less constricted since the coat or jacket in effect "floats" above the shoulders away from the arm pivot.

As shown in FIG. 1 a typical coat jacket consists of a body portion 10 and sleeve 12 connected thereto by appropriate stiching along seam line 14.

FIG. 2 shows a section view of the armscye arrangement of this invention. As shown by the prior art representation, a conventional armscye, while substantially elliptical in shape, has a narrow perimeter at the top portion thereof, i.e., in the upwardly facing direction. In accordance with this invention, however, the armscye 16 is canted toward the rear of the coat, as shown, to provide an elongated perimeter in the upwardly-facing direction. As described in more detail hereinafter, constructing the body portion so as to provide for an armscye disposed and oriented in this manner permits upwardly and outwardly directed forces introduced into the coat construction to act upon a larger surface area. At the same time, the lower perimeter of the armscye, i.e., that portion in the downwardly-facing direction, which otherwise would similarly be elongated due to the rearward canting of the armscye, is reduced in area. An example of accomplishing this criteria is shown in FIG. 2 by dotted line 18 defining segment 20 which is "removed" from a conventional armscye. In this manner the area upon which the natural downwardly-directed weight forces act is reduced.

It will of course be appreciated that the terms "elongated upper perimeter" and "reduced lower perimeter" are to some degree relative and best illustrated with reference to conventional armscye construction. The maximum elongation and reduction are not per se of importance and are dictated merely by the practical consideration of providing an adequately sized armhole.

The foregoing construction is more particularly illustrated with reference to the quadrants formed in the armscye by the cross-lines shown in FIG. 2. Quadrant *a*, hereinafter referred to as the front upper quadrant is positioned and formed so as to dispose a substantial portion of its arc perimeter in the upwardly-facing direction, i.e., toward the shoulder area of the coat. At the same time, quadrant *b*, the front lower quadrant is reduced in its arc perimeter as shown by the dotted line. As eventually constructed, the armscye as shown is continued to be referred to as substantially elliptical in shape. The reduction in the lower perimeter need not, of course, take the form of a straight line as shown but can be accomplished in any well-known manner.

An alternative manner of illustrating the unique armscye orientation of this invention is shown in the schematic armscye of FIG. 2A. Thus, perpendicular horizontal and vertical lines, relative to ground level, the vertical line originating at the center of the shoulder, will divide the armscye such that substantially dissimilar upper quadrants are formed. The perimeter of the rearward-facing upper quadrant is substantially greater than that of the front-facing upper quadrant.

FIG. 3 is a view showing the armscye and sleeve construction of this invention. As shown by the prior art representative illustration, a conventional sleeve is, before sewing into the armscye, generally of a contour analogous with the armhole opening, the material in the sleevehead being sufficient to provide a uniform amount of material for stiching to the armscye perimeter. In accordance with this invention, however, as shown by the figure, sleeve 12 is provided with excess fabric or material in the top or upper portion of the sleevehead which is stiched and gathered-in with thread 22 to conform with the contour of the armscye 16. By "excess material" is meant more than that normally necessary to achieve attachment to the armscye in normal manufacture. The presence of this material sewn along the elongated upper perimeter of armscye 16 results in an upwardly directed tension serving to counteract the normal weight forces and provide a buoyancy of sorts at the shoulder areas. These thereby lessened weight forces permit less restricted arm movements, less natural fatigue, and less fatigue when extensive lateral or upward arm motions are repeatedly made. In stitching the sleeve to the armscye perimeter it is preferred to employ thread capable of a degree of elastic expansion. An especially useful thread for this purpose has been found to be mercerized cotton thread having a nylon core. The elasticized yarn will discipline the amount of "give" at the shoulder area during arm movements.

As shown in FIG. 4 the elongated sleevehead is also contracted during positioning to impart tension thereby adding to the upward and outward pressures which are retained in the completed garment. As in conventional garment manufacture, the remaining sleevehead portions are designed so as to be contiguous with the remaining armscye perimeter after stitching.

FIG. 5 represents an especially preferred embodiment of this invention wherein a shoulder pad is to be employed. As shown in the prior art representation, the conventional shoulder pad as manufactured is scoop-shaped to provide a concave inner surface conforming to the upper shoulder curve. In accordance with this invention, however, a straight-ended shoulder pad 24 is employed.

As more clearly illustrated in the sequential steps of FIG. 6, this straight-ended pad 24 is tacked along the outside edge at the front-facing portion of the shoulder curve. The pad is then bent around and angled inward toward the back of the shoulder curve, preferably about three-quarters of an inch from arm seam 26. The pad is then forced outward and tacked along the back edge. This bowing of the pad such that its inner concave surface achieves a spaced relation above the arm seam, i.e., above the upper armscye perimeter, permits room for the exertion of upward and outwardly directed pressures as earlier described. The bowing places the pad in an upwardly-directed tensed position which aids in buoying the weight of the garment above the shoulder area.

In manufacturing the garment of this invention, a body portion is formed from appropriate fabric. The body is formed so as to result in armscye as herein before described, i.e., having an elongated upper perimeter and a reduced lower perimeter. A sleeve is then provided for attachment at the armscye perimeter in contoured relation thereto. Excess material provided in the upper portion of the sleeve is gathered-in to conform to the armscye shape and stitched, preferably with elasticized yarn as previously described, at the upper portion of the armscye so as to impose an upwardly directed tension at that point. Where a pad is to be included across the shoulder portion, a substantially straight-edged pad is provided and attached at one side of the armscye perimeter. The pad is then bowed across the upper perimeter of the armscye and attached to an opposite side of the armscye to impart to the pad upwardly-directed forces, i.e., toward the shoulder area. The inner concave surface of the pad, resulting from the bowing during attachment, is preferably in a spaced relation above the upper perimeter of the armscye.

While this invention has been described with reference to particular embodiments they are intended to be merely illustrative. Obvious modifications and alterations can be practiced without departing from the scope and spirit of the invention as defined by the appended claims.

What is claimed is:

1. A shoulder construction for a garment comprised of a substantially elliptical armscye having upward and downward facing portions, disposed within the body portion of said garment at the shoulder area thereof and canted toward the rear of said garment, said armscye being of reduced perimeter at the downward facing portion thereof;

a sleeve attached to the garment at said armscye in contoured relation thereto, the upper portion of said sleeve having an excess of material gathered-in at the connection of the sleeve with the upward facing portion of said armscye.

2. A shoulder construction in accordance with claim 1 further comprised of a bowed shoulder pad attached to said armscye, the concave inner surface of said pad being in spaced relation above the upward facing portion of said armscye.

3. A shoulder construction in accordance with claim 2 wherein said sleeve is attached to the armscye by means of stitching with elasticized thread.

4. The shoulder construction of claim 3 wherein said thread is mercerized cotton having a nylon core.

5. The shoulder construction of claim 1 wherein the upper portion of said sleeve is contracted at the connection of the sleeve with the upward facing portion of the armscye.

6. A shoulder construction for a garment comprising a substantially elliptical-shaped armscye disposed within the body portion of said garment at the shoulder area thereof and canted toward the rear of said garment, said armscye oriented such that perpendicular horizontal and vertical lines relative to ground level, the vertical line originating from the center of the shoulder area, divide said armscye into quadrants wherein the perimeter of the rearward-facing upper quadrant is substantially greater than that of the front-facing upper quadrant, said armscye having downward-facing lower quadrant of reduced perimeter;

a sleeve attached with elasticized thread to the garment at said armscye in contoured relation thereto, said sleeve having an excess of material gathered-in at the connection of the sleeve with the upper quadrant portion of said armscye.

7. A method of manufacturing a garment having a body portion and sleeves comprising the steps of:

a. forming a body portion from appropriate fabric so as to provide an armscye at the shoulder areas thereof canted toward the rear of said garment and having a reduced perimeter in the downward direction;

b. providing a sleeve, the upper portion of said sleeve having an excess of material greater than that normally required for attachment at said armscye; and c. attaching said sleeve to said armscye at the contours thereof, and gathering-in said excess material at the point of attachment with said armscye.

8. A method according to claim 7 further comprising positioning a pad in the shoulder area of said garment, attaching said pad to one side of said armscye, bowing said pad across the top of said armscye, and attaching said pad to the opposite side thereof, the inner concave surface of said pad resulting from said bowing being in a predetermined spaced relationship above the top of said armscye.

9. A method in accordance with claim 8 wherein said sleeve is attached to said armscye by stitching with elasticized thread.

10. A method in accordance with claim 9 wherein said thread is mercerized cotton having a nylon core.

11. A method in accordance with claim 8 further comprising contracting the upper portion of said sleeve at the connection of the sleeve with the upper portion of the armscye.

* * * * *